US005306177A

United States Patent [19]

Burke et al.

[11] Patent Number: 5,306,177

[45] Date of Patent: Apr. 26, 1994

[54] INSULATION DISPLACEMENT TERMINATION SYSTEM FOR INPUT-OUTPUT ELECTRICAL CONNECTOR

[75] Inventors: Rodger W. Burke, Lisle; Paul A. Reisdorf, LaGrange; Stephen A. Sampson, Downers Grove, all of Ill.

[73] Assignee: Molex Incorporated, Lisle, Ill.

[21] Appl. No.: 15,704

[22] Filed: Feb. 9, 1993

[51] Int. Cl.[5] ..... H01R 4/24

[52] U.S. Cl. ..... 439/395

[58] Field of Search ..... 439/389–425

[56] References Cited

U.S. PATENT DOCUMENTS

| | | | |
|---|---|---|---|
| 4,144,975 | 9/1978 | Weidler | 439/395 |
| 4,255,009 | 3/1981 | Clark | 339/97 P |
| 4,266,843 | 5/1981 | Marsh et al. | 439/398 |
| 4,315,663 | 2/1982 | Olsson | 439/398 |
| 4,439,001 | 3/1984 | Curley et al. | 339/176 MP |
| 4,593,963 | 6/1986 | Endo et al. | 339/97 R |
| 4,891,019 | 1/1990 | Olsson | 439/404 |
| 4,909,754 | 3/1990 | Paradis | 439/395 |
| 4,946,390 | 8/1990 | Smyers | 439/404 |
| 5,133,672 | 7/1992 | Nelligan, Jr. et al. | 439/397 |

*Primary Examiner*—Joseph H. McGlynn

*Attorney, Agent, or Firm*—A. A. Tirva

[57] ABSTRACT

An insulation displacement termination system is provided for an input-output electrical connector which includes a dielectric housing having a top face and a bottom face with a terminal-receiving passage therebetween. At least one terminal includes an insulation displacement section generally at the bottom face of the housing for termination to an insulated electrical conductor through a lower mouth of the passage in the bottom face of the housing. The terminal includes a contact section projecting through an open upper end of the passage generally in the top face of the housing for engaging a complementary mating electrical component. The terminal is configured for insertion into the terminal-receiving passage through the lower mouth thereof. Complementary interengaging abutment means are provided between the insulation displacement section of the terminal and the housing to define a stop-limit position of the terminal and to provide support for the insulation displacement section during termination to the insulated electrical conductor. Complementary interengaging latch means are provided between the contact section of the terminal and the housing within the passage for holding the terminal in the passage.

5 Claims, 2 Drawing Sheets

INSULATION DISPLACEMENT TERMINATION SYSTEM FOR INPUT-OUTPUT ELECTRICAL CONNECTOR

FIELD OF THE INVENTION

This invention generally relates to the art of electrical connectors and, particularly, to an insulation displacement termination system for an input-output electrical connector which electrically couples a plurality of conductors with an electronic component or device.

BACKGROUND OF THE INVENTION

There are many applications in the electronic industry, such as in copying machines, computers and the like, wherein a plurality of conductors must be terminated to various electronic components to carry out various functions of a machine or apparatus. For instance, in a copying machine, control electronics are fed through data conductors or lines and power conductors or lines to various devices, such as motors, audible or visual indicators, or the like which perform the various functions of the machine, such as changing the reduction of the copying process, varying the numbers of copies, rendering audible or visual signals, and the like. Electronic components or devices, such as printed circuit boards, integrated circuit chips, headers or connectors must be coupled through electrical connectors to the power and data transmission conductors or lines.

An example of an electrical connector for use with electronic systems of the character described above is shown in U.S. Pat. No. 5,125,846, dated Jun. 30, 1992 and assigned to the assignee of this invention. When the input-output electrical connector shown in that patent is used to couple a printed circuit board to a plurality of discrete insulated wire conductors, terminals are mounted in the connector and each terminal has an insulation displacement section at one end for termination to one of the discrete insulated wire conductors and a contact section at a second end for surface-mount engaging the printed circuit board. The insulation displacement section or end of the terminal is located generally at the bottom surface of the connector, and the surface-mount engaging section or end projects upwardly through a top surface of the connector.

In the electrical connector system shown in the patent U.S. Pat. No. 5,125,846, the terminals are top-loaded into the connector. In other words, the insulation displacement sections or ends of the terminals are inserted into respective receiving cavities from the top of the connector. The terminals are retained within the connector housing by locking lances projecting from the terminals. The locking lances are utilized to oppose the forces developed during termination of an insulated wire conductor into the insulation displacement section of the terminal. Although the electrical connector shown in that patent has proven quite effective for its intended purposes, there has arisen various applications wherein the insulation displacement termination forces are too great for the prior locking lances of the terminals to withstand. This invention is directed to solving such problems and providing a new design of an insulation displacement termination system for input-output electrical connectors of the character described.

SUMMARY OF THE INVENTION

An object, therefore, of the invention is to provide a new and improved insulation displacement termination system for an input-output electrical connector.

In the exemplary embodiment of the invention, the connector includes a dielectric housing having a top face and a bottom face with a terminal-receiving passage therebetween. At least one terminal includes an insulation displacement section generally at the bottom face of the housing for termination to an insulated electrical conductor through a lower mouth of the passage in the bottom face of the housing, and a contact section projecting through an open upper end of the passage generally in the top face of the housing for engaging a complementary mating electrical component.

The invention contemplates that the terminal be configured for insertion into the terminal-receiving passage through the lower mouth thereof. Complementary interengaging abutment means are provided between the insulation displacement section of the terminal and the housing within the passage to define a stop-limit position of the terminal and to provide support for the insulation displacement section during termination to the insulated electrical conductor. Complementary interengaging latch means are provided between the contact section of the terminal and the housing within the passage for holding the terminal in the passage.

As disclosed herein, the terminal is fabricated of stamped and formed sheet metal material, and the insulation displacement section is formed by at least one planar portion having an insulation-piercing slot opening toward the mouth of the passage. The complementary interengaging abutment means are provided by a top edge of the planar portion for abutting against a shoulder of the housing within the passage. The complementary interengaging latch means are provided by at least one spring tab on the contact section for camming into a snap-latched position behind a latch shoulder of the housing. The contact section of the terminal includes a base portion extending transversely of the passage and a reverse-bend spring contact portion projecting through the open upper end of the passage. The spring tab is integral with the base portion.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
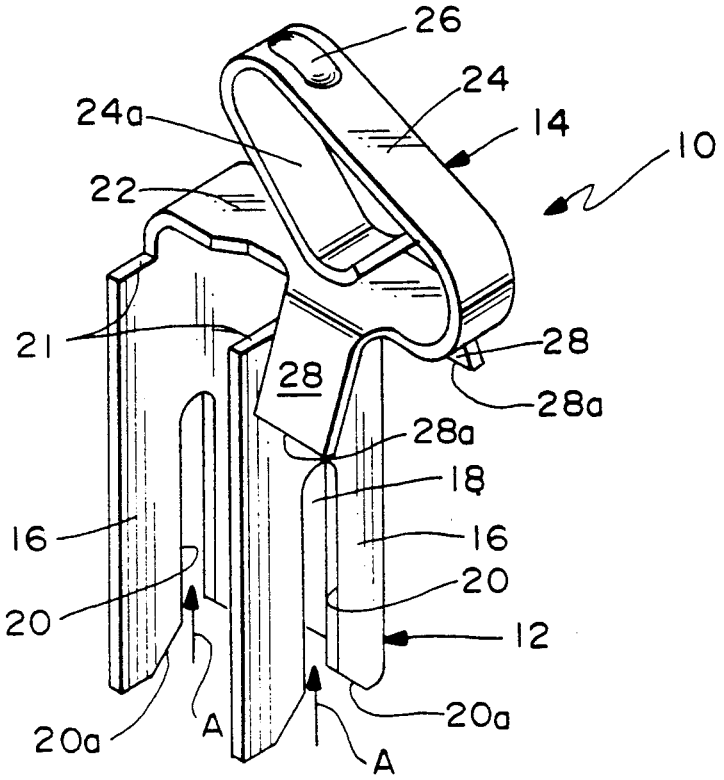
FIG. 1 is a perspective view of a terminal incorporating the concepts of the invention.

Referring to the drawings in greater detail, and first to FIG. 1, the insulation displacement termination system of the invention utilizes at least one terminal, generally designated 10, which is designed for coupling or interconnecting a discrete insulated electrical conductor with another electrical component, such as a printed circuit board. Preferably, the terminal is fabricated of stamped and formed sheet metal material and includes an insulation displacement section, generally designated 12, at one end thereof, and a surface-mount engaging or contact section, generally designated 14, at an opposite end thereof.

More particularly, insulation displacement section 12 of terminal 10 is formed by a pair of generally parallel planar portions 16 joined along adjacent edges thereof by a planar bight portion 18. Each planar portion 16 includes an insulation-piercing slot 20 having a chamfered guiding or lead-in opening 20*a*. As is known in the art, insulation displacement section 12 is effective for termination with an insulated electrical conductor by driving the conductor into slots 20, in the direction of arrows "A", whereby the edges of slots 20 cut through the insulation of the conductor and establish termination or conductivity with the conductive core or wire of the insulated conductor. Lastly, insulation displacement section 12 of terminal 10 includes abutment surfaces 21 defined by the top edges of planar portions 16 and which form part of the complementary interengaging abutment means of the termination system of the invention.

Contact section 14 of terminal 10 includes a generally planar base portion 22 extending across the top of the planar insulation-displacement portions 16, generally perpendicular thereto, and a reverse-bend spring contact portion 24 at the top end of the terminal. The reverse-bend spring contact portion 24, itself, may have a reverse-bent distal end 24*a* which is engageable with base portion 22 as an anti-overstress feature of the terminal. The contact section may include a raised boss 26 which can be plated and define a discrete or positive contact point for surface-mount engaging a circuit trace on a printed circuit board. Lastly, contact section 14 of terminal 10 includes a pair of spring tabs 28 bent downwardly from opposite sides of base portion 22 for defining part of a complementary interengaging latch means of the termination system, as described hereinafter.

Figure 2:
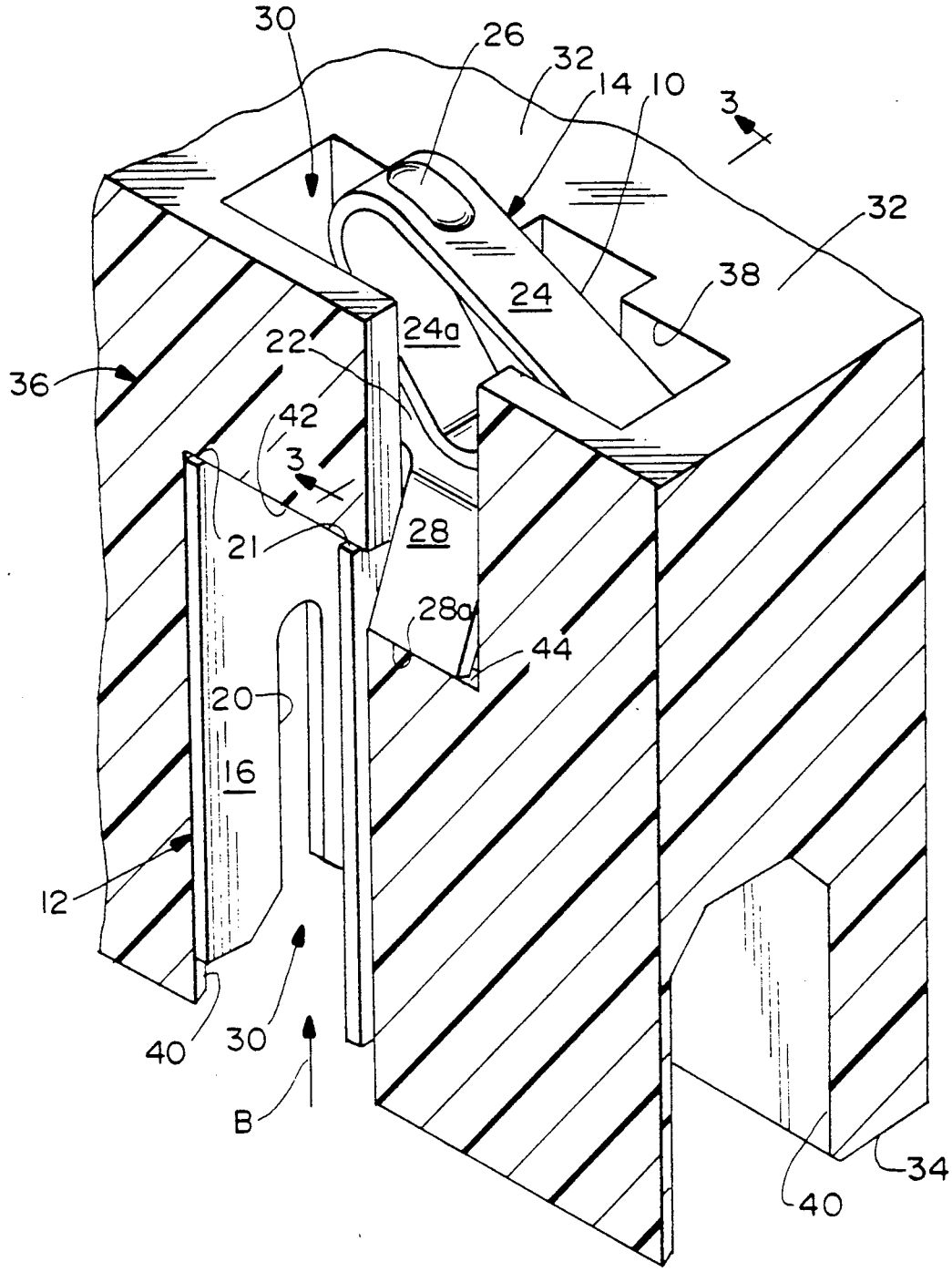
FIG. 2 is a fragmented sectional view through a connector housing within which the terminal of FIG. 1 is mounted.

Referring to FIG. 2 in conjunction with FIG. 1, terminal 10 is mounted within a terminal-receiving passage, generally designated 30, extending between a top face 32 and a bottom face 34 of an electrical connector housing, generally designated 36, of dielectric material. At this point, it should be understood that the insulation displacement termination system of the invention is directed to the structural interrelationship between terminal 10 and housing 36. The invention may be incorporated in a plurality of such terminals mounted within an input-output electrical connector of the character described in the aforementioned U.S. Pat. No. 5,125,846 which is incorporated herein by reference. Suffice it to say, contact section 14 of terminal 10 projects through an open upper end 38 of passage 30, generally in top face 32 of housing 36, for engaging a complementary mating electrical component such as a circuit trace on a printed circuit board surface mounted to top face 32 of the housing. Insulation displacement section 12 of terminal 10 is located generally at bottom face 34 of housing 36 for termination to an insulated electrical conductor inserted through a lower mouth 40 of the housing, the lower mouth intersecting and communicating with passage 30 to, in essence, define a lower mouth of the passage.

The invention contemplates that terminal 10 be inserted into terminal-receiving passage 30 through lower mouth 40 in the direction of arrow "B" (FIG. 2). Generally, complementary interengaging abutment means are provided between insulation displacement section 12 of the terminal and housing 36 within passage 30 to define a stop-limit position of the terminal as shown in FIG. 2. In this position, support is provided for insulation displacement section 12 during termination of the insulated electrical conductor driven into mouth 40 which is the same direction as inserting the terminal into the housing. More particularly, it can be seen in FIG. 2 that top edges 21 of the insulation displacement section of terminal 10 abut against a shoulder 42 of housing 36 within passage 30. Therefore, after the terminal is inserted into the passage and to its stop-limit position with edges 21 in abutment with shoulder 42, this solid complementary interengaging abutment means reacts against the termination forces involved in driving the insulated electrical conductor into slots 20 of the insulation displacement section of the terminal. Specifically, the insulation displacement termination forces, thereby, are isolated from contact section 14 of the terminal.

Figure 3:
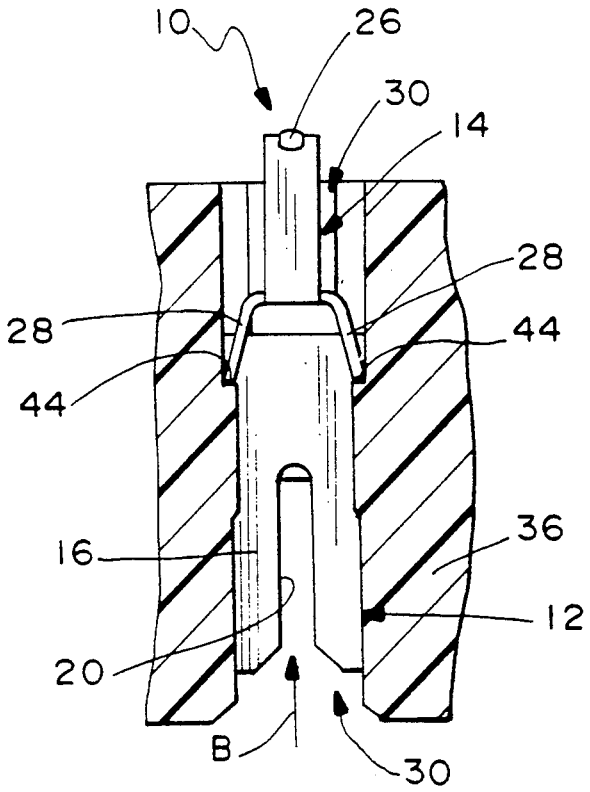
FIG. 3 is a vertical section taken generally along line 3—3 of FIG. 1, with the terminal in elevation.

Generally, complementary interengaging latch means are provided between contact section 14 of terminal 10 and housing 36 within passage 30 for holding the terminal in the passage, i.e. retaining the terminal opposite its insertion direction indicated by arrow "B" (FIG. 2). More particularly, referring to FIG. 3 in conjunction with FIG. 2, it can be seen that housing 36 has a pair of latch shoulders 44 in passage 30 for engagement by lower edges 28*a* of spring tabs 28. As best seen in FIG. 3, spring tabs 28 are angled outwardly of the terminal. Therefore, as the terminal is inserted into passage 30 in the direction of arrow "B", the spring tabs will be cammed inwardly to store spring energy therewithin. Once the terminal reaches its stop-limit position described above and shown best in FIG. 2, spring tabs 28 snap outwardly in opposite directions and interengage behind latch shoulders 44 of the housing, which prevents the terminal from backing out of passage 30 opposite the direction of arrow "B". The fully latched position of the terminal is shown in FIG. 3, with spring tabs 28 latched behind shoulders 44. The latching interengagement of contact section 14 with housing 36, as afforded by spring tabs 28 and latch shoulders 44, is completely independent of the complementary interengaging abutment means 21,42 described above.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an insulation displacement termination system for an input-output electrical connector which includes a dielectric housing having a top face and a bottom face with a terminal-receiving passage therebetween, at least one terminal including an insulation displacement section generally at the bottom face of the housing for termination to an insulated electrical conductor through a lower mouth of the passage in the bottom face of the housing and a contact section projecting through an open upper end of the passage generally in the top face of the housing for engaging a complementary mating electrical component, wherein the improvement comprises the terminal being configured for insertion into the terminal-receiving passage through the lower mouth thereof and including complementary interengaging abutment means between the insulation displacement section of the terminal and the housing within the passage to define a stop-limit position of the terminal and to provide support for the insulation displacement section during termination to the insulated electrical conductor, and complementary interengaging latch means between the contact section of the terminal and the housing within the passage for holding the terminal in the passage.

wherein said complementary interengaging latch means include at least one spring tab on the contact section for camming into a snap-latched position behind a latch shoulder of the housing, and wherein the terminal is fabricated of stamped and formed sheet metal material, said contact section of the terminal comprises a base portion extending transversely of the passage and a reverse-bend spring contact portion projecting through the open upper end of the passage, and said at least one spring tab is integral with said base portion.

2. In an insulation displacement termination system as set forth in claim 1, the terminal is fabricated of stamped and formed sheet metal material and the insulation displacement section is formed by at least one planar portion having an insulation-piercing slot opening toward the mouth of the passage, and said complementary interengaging abutment means comprises a top edge of the planar portion for abutting against a shoulder of the housing within the passage.

3. In an insulation displacement termination system as set forth in claim 2, wherein the insulation displacement section of the terminal is formed by a pair of said planar portions in a generally parallel array with aligned insulation-piercing slots, both planar portions including top edges for abutment against shoulders of the housing.

4. In an insulation displacement termination system as set forth in claim 3, wherein said contact section of the terminal comprises a base portion extending transversely of the passage from a top edge of one of said planar portions toward the other planar portion and a reverse-bend spring contact portion projecting through the open upper end of the passage.

5. In an insulation displacement termination system as set forth in claim 4, wherein said complementary interengaging latch means include at least one spring tab projecting outwardly of the base portion of the contact section for camming into a snap-latched position behind a latch shoulder of the housing.

* * * * *